US006019088A

United States Patent [19]

Stevens et al.

[11] Patent Number: 6,019,088

[45] Date of Patent: Feb. 1, 2000

[54] MOUNTING ARRANGEMENT

[75] Inventors: John William Stevens, Gillingham; Alan Conway Green, Maidstone; Carl Stalker, Rochford, all of United Kingdom

[73] Assignees: Lucas Industries, Solihill, United Kingdom; Ford Global Technologies, Inc., Dearborn, Mich.

[21] Appl. No.: 09/108,557

[22] Filed: Jul. 1, 1998

[30] Foreign Application Priority Data

Jul. 2, 1997 [GB] United Kingdom ..... 9714036

[51] Int. Cl.[7] ..... F02M 37/04

[52] U.S. Cl. ..... 123/470; 239/600

[58] Field of Search ..... 123/470, 472, 123/469, 456, 468, 509; 239/600

[56] References Cited

U.S. PATENT DOCUMENTS

| | | | |
|---|---|---|---|
| 2,897,800 | 8/1959 | Haas | 123/470 |
| 3,908,911 | 9/1975 | Hofmann et al. | 239/533 |
| 4,050,722 | 9/1977 | Berger et al. | 285/175 |
| 4,066,213 | 1/1978 | Stampe | 123/700 |
| 4,815,666 | 3/1989 | Gacka | 239/600 |
| 5,070,845 | 12/1991 | Audenko | 123/470 |
| 5,421,522 | 6/1995 | Bowen | 239/600 |
| 5,617,828 | 4/1997 | Kuegel | 123/470 |
| 5,727,739 | 3/1998 | Hamilton | 239/600 |
| 5,875,976 | 3/1999 | Nelson | 239/600 |

FOREIGN PATENT DOCUMENTS 292199 10/1953 Switzerland .

*Primary Examiner*—Carl S. Miller

*Attorney, Agent, or Firm*—Wells, St. John, Roberts, Gregory & Matkin, P.S.

[57] ABSTRACT

A mounting arrangement for mounting a component, for example a fuel injector, in a desired position comprises a sleeve which surrounds part of the component and includes a screw-threaded end region. At a point spaced from the first end, the sleeve defines a groove arranged to receive a resilient member which cooperates, in use, with a groove provided in the component to secure the component to the sleeve.

18 Claims, 1 Drawing Sheet

10
22
16
14
12

18
16

18
16
20

16b
16
16a 14
16
18
20
22a
22
10

14
16
18
20
22
10
12
24

MOUNTING ARRANGEMENT

This invention relates to an arrangement for mounting a component in a desired position. This invention is particularly suitable for use in mounting a fuel injector in position in a bore of an engine to permit fuel to be delivered by the injector to a cylinder of the engine. It will be appreciated, however, that the invention may also be used in other applications, for example mounting a spark plug, a sensor or a fuel line connector in a desired position.

FIG. 1 illustrates a known arrangement for mounting a fuel injector in position. As shown in FIG. 1, an annular groove of part circular cross-sectional shape is provided in the exterior of the nozzle holder 10 of an injector 12. An O-ring or circlip 14 is received within, and protrudes from the groove. A gland nut in the form of a cylindrical sleeve 16 is located around the nozzle holder 10, the interior of the sleeve 16 being shaped, at a first end thereof, to engage the circlip 14. The exterior of the sleeve 16, at the first end thereof, is provided with a screw-threaded region which, in use, cooperates with corresponding threads provided on the interior of the bore to secure the injector 12 in position, the injector being clamped between the sleeve 16, through the circlip 14, and a step formed in the bore. The opposite end of the sleeve 16 is shaped to include flats dimensioned to permit an appropriate tool to be used to rotate the sleeve 16 to secure the sleeve 16 and injector 12 in position.

It has been found that, in use, the end of the nozzle holder 10 remote from the nozzle of the injector tends to vibrate. Additionally, differential thermal expansion between the injector and some constructions of cylinder head has a tendency to reduce the clamping force and further increases the effects of vibration. Where the injector is relatively long, such vibrations are particularly disadvantageous. In order to reduce such effects, the level of strain energy can be increased, the circlip could be spaced from the first end of the sleeve, thus supporting a part of the injector remote from the nozzle. However, in order to allow assembly, the internal diameter of the part of the sleeve between the first end thereof and the circlip would have to be increased, thus reducing the wall thickness resulting in the sleeve being of undesirably reduced strength. The outer diameter of the sleeve cannot, in practice, be increased to maintain the wall thickness as the increased diameter would require the bores in the cylinder head to be of undesirably increased diameter. It is an object of the invention to provide an injector arrangement in which the disadvantageous effects described hereinbefore are reduced.

Further, the lack of compliance in such an arrangement may result in undesirable loosening of the injector, in use, due to settling of the mating surfaces.

According to the present invention there is provided a mounting arrangement for use in securing a component in a desired position comprising a sleeve arranged to surround part of the component, the sleeve being provided, at a first end thereof, with a fixing region, the sleeve including a first annular groove arranged to receive a substantially annular resilient member, the member being engageable within a second annular groove provided in the component, wherein the first annular groove is spaced from the first end of the sleeve.

It will be appreciated that by locating the first annular groove away from the first end of the sleeve, the component is supported through the annular member at a location further from an end thereof than in the known arrangement, thus the disadvantageous vibrations are reduced, and the arrangement is of improved compliance.

The first annular groove is conveniently of sufficient depth that the substantially annular resilient member can be received therein so as not to impede movement of the component relative to the sleeve.

The fixing region conveniently comprises a screw threaded region of the sleeve.

The component conveniently comprises a fuel injector.

The invention will further be described, by way of example, with reference to the accompanying drawings, in which.

Figures 1, 2, 3, 4, 5, 6:
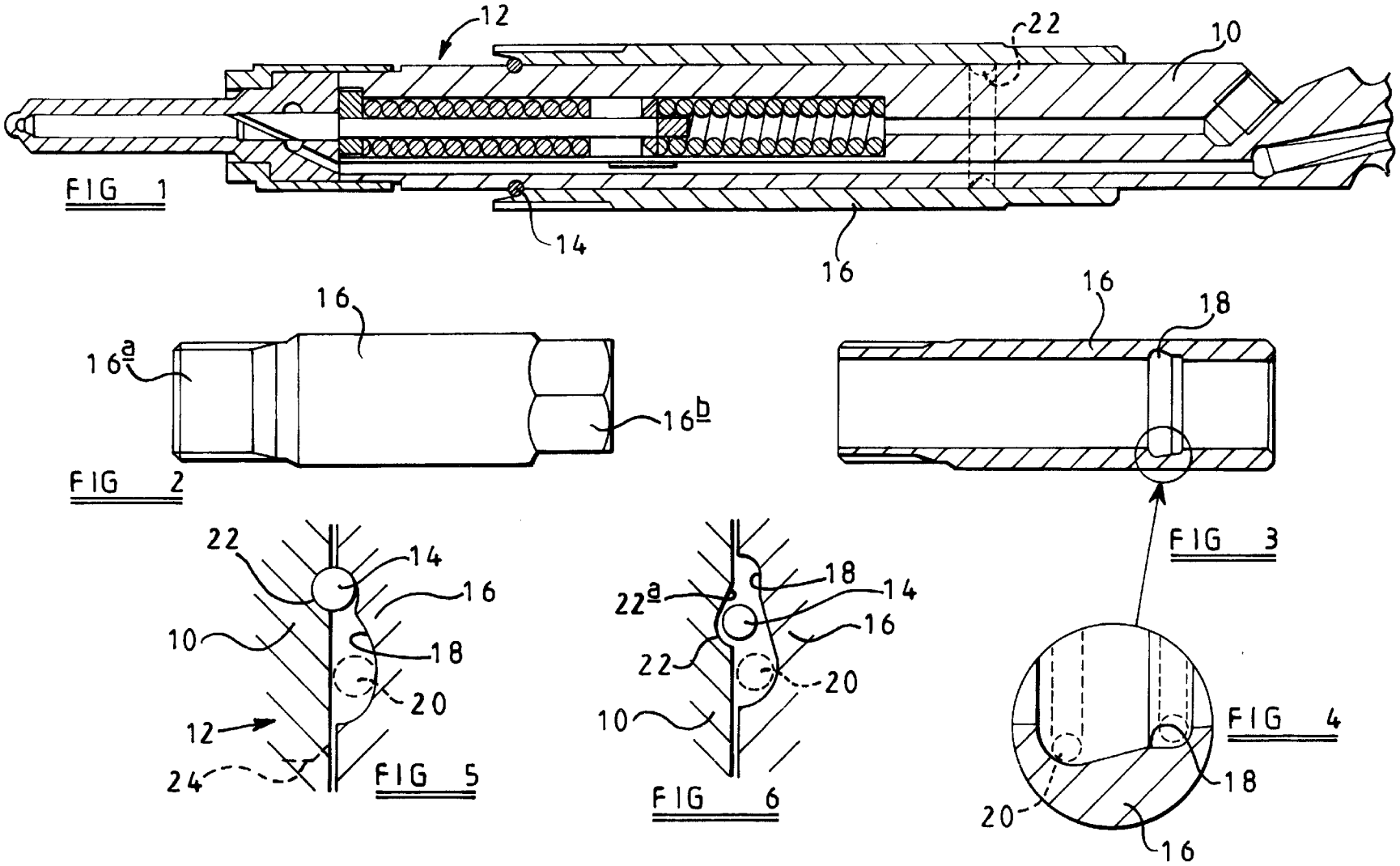
FIG. 1 is a sectional view of a known injector arrangement.
FIG. 2 is a side view of a sleeve forming part of an injector mounting arrangement in accordance with an embodiment of the invention.
FIG. 3 is a sectional view of the sleeve of FIG. 2.
FIG. 4 is an enlargement of part of FIG. 3.
FIG. 5 is a diagrammatic view of the arrangement, in use.
FIG. 6 is a diagrammatic view of a modification.

FIGS. 2 and 3 illustrate a sleeve 16 forming part of an injector mounting arrangement in accordance with an embodiment of the invention. As illustrated in FIG. 2, the sleeve 16 is of cylindrical form, a first end 16*a* thereof being provided with external screw-thread formations arranged, in use, to cooperate with corresponding formations formed on the interior of a bore of an engine cylinder head within which the injector 10 is received. A second end 16*b* of the sleeve 16 is of hexagonal form to permit the sleeve 16 to be rotated using an appropriate tool to secure the sleeve 16 in position. It will be appreciated that the sleeve may be provided with formations other than screw thread formations for securing the sleeve in position, if desired.

As shown in FIG. 3, the sleeve 16 includes an axially extending through bore which is of substantially uniform diameter, the diameter of the through bore being slightly larger than the diameter of the nozzle body 10 of the injector 12 to be secured in position as shown in FIG. 5. At a position remote from the first end 16*a*, the sleeve 16 is provided with an interior annular groove 18. As best shown in FIGS. 4 and 5, the annular groove 18 is of tapering depth, and the depth of the part of the groove 18 closest to the first end 16*a* of the sleeve 16 is sufficiently large to enable a circlip 14 to be received entirely therein, the circlip 14 not impeding insertion of the injector 12 into the bore when in this position. Dashed lines 20 in FIGS. 4 and 5 illustrate the circlip 14 in this position.

The injector 12 is modified so that rather than including an annular groove in a position adjacent the first end 16*a* of the sleeve 16 as in the arrangement illustrated in FIG. 1, the exterior of the nozzle body 10 is provided with an annular groove 22 at a location which, in use, aligns with the groove 18 provided in the sleeve 16. The location of the groove 22 is indicated by dashed lines in FIG. 1, although it will be appreciated that no such groove is provided in this location in the arrangement illustrated in FIG. 1. The depth of the groove 22 is substantially equal to half of the diameter of the material of the circlip 14 such that when the circlip 14 is received within the groove 22, approximately half of the diameter of the circlip protrudes from the exterior of the nozzle holder 10, this part of the circlip extending into the groove 18 provided in the sleeve 16 as shown in FIG. 5.

In use, prior to locating the injector 12 in the bore of the cylinder head, the injector 12 is inserted into the bore of the sleeve 16, the circlip 14 having already been located within the groove 18 of the sleeve. The action of inserting the injector 12 into the sleeve expands the circlip 14 resulting in the circlip 14 being located completely within the groove 18, the circlip 14 occupying the position indicated at 20 in FIGS. 4 and 5. In order to assist in expanding the circlip 14 in this manner, the end of the nozzle body 10 may be chamfered as denoted by dashed lines 24 in FIG. 5. Once the circlip 14 occupies the position denoted by the dashed lines 20 in FIGS. 4 and 5, continued insertion of the injector 12 may continue without being impeded by the presence of the circlip 14. Such movement continues until the groove 22 provided in the exterior of the nozzle holder 10 registers with the groove 18 provided in the sleeve 16. Once such registration occurs, the circlip 14 locates within the groove 22 provided in the nozzle holder 10, the circlip protruding from the groove 22 provided in the nozzle holder 10 into the groove 18 provided in the sleeve 16, thus securing the sleeve 16 to the nozzle holder 10 whilst permitting a degree of relative axial movement of the sleeve 16 and injector 12. Once this position has been achieved, the injector 12 and first end 16*a* of the sleeve 16 can be located within the bore of the cylinder head, and the sleeve 16 rotated so that the screw-thread formations provided at the first end 16*a* engage with those of the bore to secure the injector 12 and sleeve 16 within the bore. As the sleeve 16 is rotated, the cooperation of the threaded formations results in axial movement of the sleeve 16 and injector 12 into the bore. Subsequently, the injector 12 engages a step located within the bore preventing further axial movement of the injector 12. Continued rotation of the sleeve 16 results in relative axial movement of the sleeve 16 and injector 12 causing the circlip 14 to move to the position shown in FIG. 5 in which the circlip 14 is clamped against an end of the groove 18. In this position, the injector 12 is firmly clamped in position, the clamping force being transmitted through the circlip 14. The increased clamping length allows greater levels of strain energy to be stored in the holder body and sleeve in order to resist loosening as a result of vibration and/or by the effects of thermal expansion.

It will be appreciated that the sleeve 16 is secured rigidly in position by virtue of its threaded engagement in the bore. The location of the circlip in the grooves at a position spaced from the first end of the sleeve results in a part of the injector relatively close to the end thereof remote from the nozzle being rigidly supported. Such rigid support of this part of the injector reduces movement of this end of the injector, for example resulting from vibrations.

The circlip conveniently takes the form of a length of wire bent to take a substantially annular form, but it will be appreciated that other types of resilient annular member, for example an O-ring, may be used. The circlip is conveniently of oval form to assist in initial insertion of the circlip into the bore of the sleeve and the groove 18, and to assist final engagement in the corresponding groove 22 of the injector. The oval form of the circlip also reduces the risk of the circlip falling completely through the bore of the sleeve during assembly.

Although the groove 22 provided in the nozzle holder 10 may be of semicircular cross-section as described hereinbefore, it is envisaged that the shape of the groove may be modified to include a ramped surface 22*a* as illustrated in FIG. 6. Should it be necessary to remove the injector from the sleeve 16, downward movement of the injector 12 in the orientation illustrated in FIG. 6 results in the circlip 14 being forced to ride up the ramped surface 22*a* until the circlip 14 occupies a position in which relative movement of the injector and sleeve is no longer impeded.

Although the description hereinbefore is of an injector mounting arrangement, it will be appreciated that the invention is also applicable to arrangements for mounting other components, for example spark plugs, sensors or fuel line connectors, in their desired positions.

We claim:

1. A mounting arrangement for a component provided with a second annular groove, comprising a sleeve arranged to surround part of the component, the sleeve being provided, at a first end thereof, with a fixing region, the sleeve including a first annular groove arranged to receive a substantially annular resilient member, the member being engageable within the second annular groove provided in the component, wherein the first annular groove is spaced from the first end of the sleeve and wherein the second annular groove includes a region defining a ramped surface arranged such that cooperation between the sleeve and the resilient member can push the resilient member over the ramped surface and out of the second annular groove to permit separation of the component from the sleeve.

2. An arrangement as claimed in claim 1, wherein the first annular groove includes a region of sufficient depth to permit the resilient member to be received substantially completely therein.

3. An arrangement as claimed in claim 1, wherein the resilient member comprises an O-ring.

4. An arrangement as claimed in claim 1, wherein the fixing region comprises a screw threaded region of the sleeve.

5. An arrangement as claimed in claim 1, wherein the component comprises a fuel injector.

6. A sleeve adapted for use in an arrangement as claimed in claim 1.

7. A mounting arrangement for a component provided with a second annular groove, comprising a sleeve arranged to surround part of the component, the sleeve being provided, at a first end thereof, with a fixing region, the sleeve including a first annular groove arranged to receive a substantially annular resilient member, the member being engageable within the second annular groove provided in the component, wherein the first annular groove is spaced from the first end of the sleeve and wherein the resilient member comprises a circlip defined by a length of wire bent to take substantially annular form.

8. An arrangement as claimed in claim 7, wherein the first annular groove includes a region of sufficient depth to permit the resilient member to be received substantially completely therein.

9. An arrangement as claimed in claim 7, wherein the fixing region comprises a screw threaded region of the sleeve.

10. An arrangement as claimed in claim 7, wherein the component comprises a fuel injector.

11. A sleeve adapted for use in an arrangement as claimed in claim 7.

12. A fuel injector assembly comprising:

a fuel injector having an annular groove;

a mounting arrangement for the fuel injector, the mounting arrangement including a sleeve arranged to surround part of the component, the sleeve having a first end, the sleeve being provided, at the first end thereof, with a fixing region, the sleeve including an annular groove arranged to receive a substantially annular resilient member, the member being engageable within the annular groove provided in the fuel injector, wherein the annular groove of the sleeve is spaced from the first end of the sleeve and wherein the annular groove of the fuel injector includes a region defining a ramped surface arranged such that cooperation between the sleeve and the resilient member can push the resilient member over the ramped surface and out of the annular groove of the fuel injector to permit separation of the fuel injector from the sleeve.

13. An assembly as claimed in claim 12, wherein the first annular groove includes a region of sufficient depth to permit the resilient member to be received substantially completely therein.

14. An assembly as claimed in claim 12, wherein the resilient member comprises a circlip defined by a length of wire bent to take substantially annular form.

15. An assembly as claimed in claim 12, wherein the resilient member comprises an O-ring.

16. An assembly as claimed in claim 12, wherein the fixing region comprises a screw threaded region of the sleeve.

17. An engine block including the assembly of claim 12.

18. An internal combustion engine including the assembly of claim 12.

* * * * *